United States Patent [19]

Boop

[11] 4,266,613

[45] May 12, 1981

[54] ARMING DEVICE AND METHOD

[75] Inventor: Gene T. Boop, Benbrook, Tex.

[73] Assignee: SIE, Inc., Ft. Worth, Tex.

[21] Appl. No.: 46,110

[22] Filed: Jun. 6, 1979

[51] Int. Cl.[3] ..... E21B 43/185; H01H 35/38

[52] U.S. Cl. ..... 166/299; 166/63; 166/65 R; 175/4.54; 175/4.56; 200/82 R

[58] Field of Search ..... 175/4.52, 4.53, 4.54, 175/4.55, 4.56; 166/299, 63, 65 R; 102/20, 21, 21.6; 200/1 R, 82 R

[56] References Cited

U.S. PATENT DOCUMENTS

| | | | |
|---|---|---|---|
| 2,543,823 | 3/1951 | Barry | 175/4.54 |
| 2,748,660 | 6/1956 | Spencer | 175/4.54 |
| 2,871,784 | 2/1959 | Blair | 166/65 R X |
| 3,011,551 | 12/1961 | Young et al. | 175/4.52 |
| 3,067,679 | 12/1962 | Caldwell et al. | 175/4.53 |
| 3,071,072 | 1/1963 | Castel et al. | 175/4.53 |
| 3,246,707 | 4/1966 | Bell | 175/4.54 |
| 3,327,792 | 6/1967 | Boop | 175/4.54 |
| 3,391,263 | 7/1968 | Young | 200/82 R |
| 3,441,093 | 4/1969 | Boop | 175/4.55 |
| 3,648,785 | 3/1972 | Walker | 175/4.54 |
| 4,007,796 | 2/1977 | Boop | 175/4.55 |

FOREIGN PATENT DOCUMENTS

| | | | |
|---|---|---|---|
| 680132 | 2/1964 | Canada | 102/21.6 |

*Primary Examiner*—Stephen J. Novosad
*Attorney, Agent, or Firm*—G. Turner Moller

[57] ABSTRACT

There is disclosed an arming and disarming device which is run into a well bore on a wireline and which is part of an explosive tool to conduct some type explosive operation in the well bore. In the disarmed configuration, the arming sub acts to separate the hot lead in the wireline from the explosive tool, to short circuit the hot and ground leads of the explosive well tool together and to connect the short circuited tool leads to ground. In one mode of use of the arming sub, hydrostatic pressure applied to the tool as it is being run into the well bore acts to move a piston inside the device. As the piston moves, the hot lead of the wireline is electrically connected to the short circuited hot and ground connections of the explosive tool. Continued movement of the piston breaks the short circuit between the hot and ground connections of the explosive tool thereby arming the tool.

17 Claims, 7 Drawing Figures

ARMING DEVICE AND METHOD

This invention relates to devices for arming explosive well tools and more particularly to a device for arming such tools in response to pressure applied to the tool.

There is a wide variety of explosive tools which are run into a well bore during completion or reworking of a hydrocarbon producing well. Such tools include tubing or casing sized perforating guns, which may either be reusable or expendable; casing cutters; string shots; sidewall coring guns; explosively actuated packers; explosively driven passage forming members to provide a bypass between the casing annulus and the tubing; and the like. Because many of these explosive well tools incorporate blasting caps and/or shaped charges, there is a danger of injury to personnel and equipment in the event the explosive charge detonates above ground. Unfortunately, there are a number of serious injuries and fatalities occuring annually because of premature detonation of the explosive charge above ground level.

There has been proposed in the prior art an arming switch incorporated in a perforating gun which acts to normally interrupt the hot lead in a perforating gun as shown in U.S. Pat. No. 2,543,823. In this device, the gun is lowered into the well and armed when the hydrostatic switch is exposed to a predetermined hydrostatic head in the well bore.

Also of interest is the disclosure in U.S. Pat. No. 3,391,263 where a normally disarmed tool includes a spring biased piston which closes a switch when the hydrostatic pressure reaches a predetermined amount. In this device, the gun is immediately fired in response to the predetermined hydrostatic pressure rather than merely arming the gun. Accordingly, this type device is usable only with one shot explosive well tools. In addition, this device has the disadvantage of requiring adjustment of the tool at the well location to take into account the depth at which the tool is to be fired, variations in well fluid density and the like. In addition, this particular tool does not allow positioning thereof from the location of casing joints and the like but is positioned and fired merely in response to hydrostatic pressure.

Also of interest in respect to this invention is the disclosure in U.S. Pat. No. 4,007,796 which discloses a multiple shot select fire perforating gun in which the hot lead passing from the wireline is separated from the tool hot and ground leads. In this device, the hot and ground leads from the explosive device are short circuited in the disarmed tool configuration. During arming, the hot lead from the wireline is connected to the tool hot lead and the short circuit is broken.

Of more general interest are the disclosures in U.S. Pat. Nos. 3,011,551; 3,067,679; 3,071,072; 3,327,792; 3,441,093; 3,648,785 and Canada Pat. No. 680,132.

In the disarmed configuration, the arming device of this invention acts to open an electrical path leading from the hot wire of the wireline to the hot lead of the explosive tool. In addition, a short circuit is provided between the hot and ground leads of the explosive tool. This short circuit is connected by an electrical path in the arming device to the ground wire of the wireline.

In one mode of use, a piston in the arming device moves in response to hydrostatic pressure in the well bore. As the piston moves, one switch contact moves into electrical connection with a contact connected to the hot wire of the wireline. Continued movement of the piston causes a second switch contact, creating the short circuit, to move thereby breaking the short circuit and arming the device.

After the explosive charges of the tool have been detonated, the expanded tool and arming device are withdrawn from the well by the wireline. As the hydrostatic pressure acting on the arming device subsides, the piston therein ultimately moves back to its disarmed position thereby disarming the explosive tool and any unexpended explosive charge thereon.

It is accordingly an object of this invention to provide an improved device for arming and disarming an explosive well tool.

Other objects and advantages of this invention will become more fully apparent as this description proceeds, reference being made to the accompanying drawings and appended claims.

IN THE DRAWINGS

Figure 1:
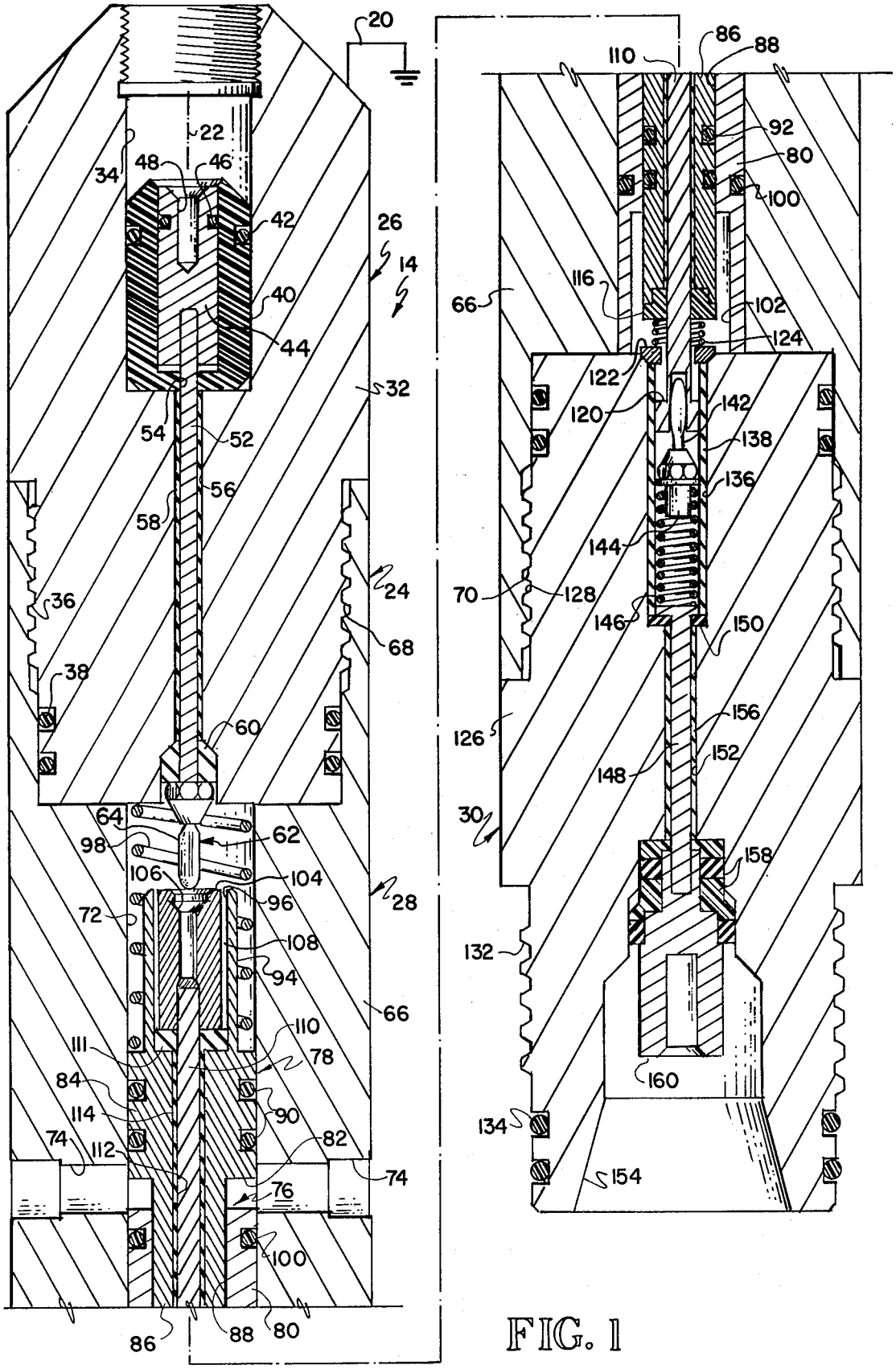
FIG. 1 is a longitudinal cross-sectional view of the arming device of this invention illustrating the same in its disarmed configuration.
Figure 3:
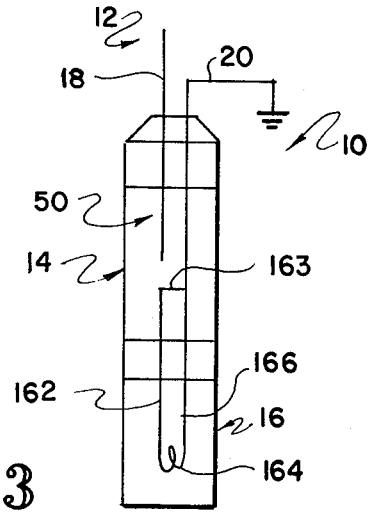
FIGS. 3–5 are schematic drawings of the arming device of this invention respectively illustrating the disarmed configuration, an intermediate configuration and the armed configuration.

Referring to FIGS. 1 and 3, there is illustrated a well assembly 10 comprising a wireline 12 connected to an arming and disarming device 14 of this invention which is in turn connected to an explosive well tool 16. The assembly 10 is accordingly runable into a well bore for conducting an explosive operation therein.

The wireline 12 includes a hot lead 18 and a ground lead 20 connecting the arming device 14 and the explosive tool 16 to a surface installation (not shown) for raising and lowering the assembly 10 into the well bore and for selectively detonating the well tool 16.

The arming device 14 is conveniently symmetrical about a longitudinal axis 22 and comprises a housing 24 having an upper section 26 configured to connect to the wireline 12, an intermediate section 28 and a lower section 30 configured to connect to the well tool 16. As will be more fully apparent hereinafter, the housing 24 is electrically conductive to provide an uninterrupted ground path between the explosive tool 16 and the wireline 12 and is accordingly conveniently of metal.

The upper housing section 26 comprises a generally cylindrical body 32 having a passage 34 opening through the top of the device 14 therein for receiving the conventional bushing (not shown) of the wireline 12. As is also conventional, an external portion of the wireline bushing makes electrical contact with the body 32 thereby electrically connecting the ground path through the housing 24 to the ground connection 20 of the wireline 12. The body 32 provides male threads 36 on the lower end thereof which cooperate with a plurality of O-ring seals 38 for sealably connecting the upper housing section 26 to the intermediate section 28.

Positioned in the passage 34 is an insulating sleeve 40 provided with a suitable O-ring seal 42 acting against the passage 34. Inside the insulating sleeve 42 is a conductive sleeve 44 providing a suitable O-ring seal 46 for sealing between the sleeves 40, 44. Opening toward the upper end of the section 26 is a blind passage 48 for receiving a prong of the wireline bushing (not shown) for connecting a normally open but closeable electrical path 50 in the device 14 to the hot lead 18 of the wireline 12.

A metal rod 52 is secured to the metal bushing 44 and extends through a passage 54 in the insulating bushing 40 and a passage 56 toward the lower end of the upper housing section 26. The metal rod 52 is coated or covered with an insulating sleeve 58 of any suitable material, such as Teflon or the like. Adjacent the lower end of the housing section 26, the metal rod 52 passes through an insulating bushing 60 and is electrically and mechanically connected to a banana plug 62 having a prong or contact 64 extending beyond the confines of the body 32.

The intermediate housing section 28 encloses most of the movable components of the device 14 and comprises a metallic body 66 having female threads 68 at the upper end thereof mating with the threads 36 of the upper housing section 28 and female threads 70 at the lower end thereof mating with complementary threads provided by the lower housing section 30. An enlarged longitudinal passage 72 extends through the body 66 and connects to one or more transverse passages 74 opening through a side of the housing section 28.

Mounted inside the passage 72 is a piston assembly 76 comprising a movable piston 78 and a sleeve 80 which cooperate to provide an unbalanced operative face 82 on the piston 78 exposed to fluid pressure through the passages 74.

The piston 78 is conveniently of metal and provides an enlarged head 84 operating in the upper end of the housing section 28 and a shank 86 extending into a passage 88 provided by the sleeve 80. The piston head 84 provides a plurality of O-rings 90 sealing against the interior of the passage 72. A second plurality of O-rings 92 are carried by the piston shank 86 and seal against the passage 88. The upper end of the piston head 84 comprises an elongate annular wall 94 of smaller external diameter than the piston head 84 providing a cavity 96 therein. A helical spring 98 is disposed in the passage 72, surrounds the annular wall 94 and acts between the lower end of the housing section 28 and the piston head 84 to bias the piston 78 downwardly.

Although the sleeve 80 could be machined from the housing body 66, it is conveniently a separate annular member positioned inside the passage 72 and provides a plurality of O-rings 100 sealing thereagainst. An enlarged cavity 102 is provided at the lower end of the sleeve 80 for purposes more fully explained hereinafter. It will be seen that the piston assembly 76 is responsive to a predetermined pressure existing in the passage 74 to bias the piston 78 upwardly against the force provided by the spring 78. When the presure existing in the passage 74 decreases below a predetermined amount, it will be seen that the spring 98 is sufficiently powerful to move the piston 78 downwardly.

Positioned in the cavity 96 is an electrically conductive sleeve or receptacle 104 having a blind passage 106 opening toward the prong 64. The receptacle 104 is electrically insulated from the piston 78 in any suitable manner, as by the provision of an insulating sleeve 108 or air gap. The receptacle 104 is connected to a metal rod 110 extending through an insulating bushing 111 and a longitudinal passage 112 in the piston 78. The metal rod 110 is insulated from the piston 78 by an insulating coating or cover 114. The metal rod 110 projects beyond the end of the piston shank 86 and passes through a stepped insulating bushing 116. The lower end of the metal rod 110 provides a blind internal passage 118 and an enlarged external lip 120 for purposes more fully explained hereinafter.

Figure 2:
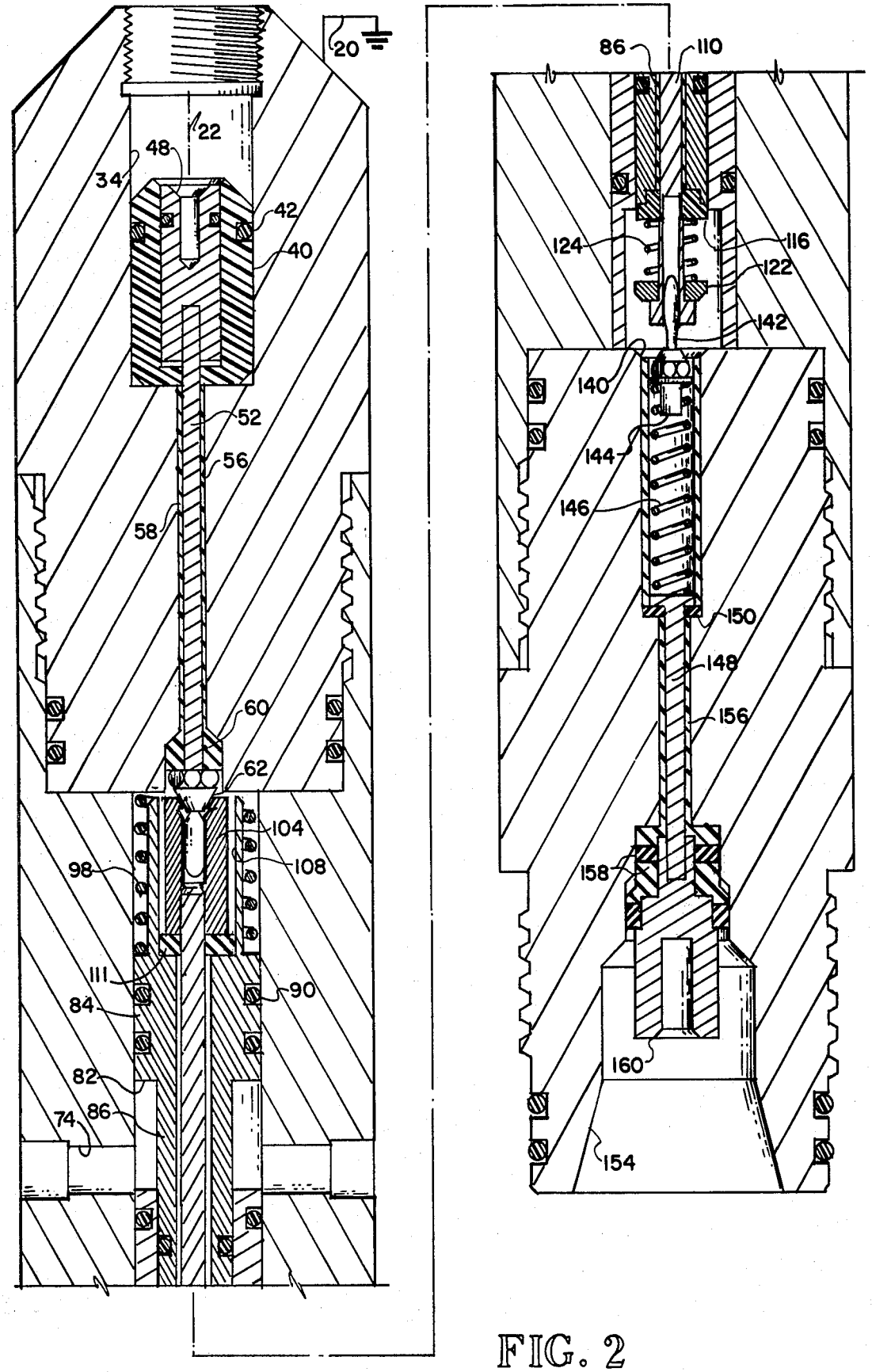
FIG. 2 is a view of the arming device of FIG. 1 illustrating the tool in its armed configuration.

As will be seen from FIGS. 1 and 2, the insulating coating 114 on the metal rod 110 extends no farther than about the location of the insulating bushing 116 so that the exterior of the rod 110 is conductive below the bushing 116. For purposes more fully explained hereinafter, a switch contact 122 comprising an annular member is slidably mounted on the bare portion of the rod 110 below the insulating bushing 116 and is biased in a downward direction by a spring 124 acting against the bushing 116.

The lower housing section 30 comprises a metal body 126 having male threads 128 and O-rings 130 which cooperate to sealably connect the lower housing section 30 to the intermediate housing section 28. The body 126 also comprises threads 132 and O-rings 134 to sealably connect the housing section 30 to the explosive well tool 16.

Positioned in a passage 136 extending from the upper end of the housing section 30 is an insulating sleeve 138 which terminates below a beveled edge 140 of the passage 136. Inside the sleeve 138 is a prong or switch contact 142 having a metal shank 144 thereon surrounded by a metal spring 146. A metal rod 148 extends through an insulating bushing 150 into electrical contact with the spring 146. The metal rod 148 extends through a passage 152 communicating between the passage 136 and a cavity 154 provided in the lower end of the housing section 30. The metal rod 148 is insulated from the housing body 128 by a coating or covering 156. The metal rod 148 extends through a plurality of insulating washers 158 to connect to an electrically conductive receptacle 160 designed to connected to a hot lead 162 of the explosive tool 16 as shown in FIG. 3.

The explosive tool 16 comprises one or more explosive devices 164 having the hot lead 162 and a ground 166 which, in the assembled position of the device 14 communicates with the metal housing body 24. As shown in FIG. 3, one electrical path is completed through the device 14 which is the ground path connecting the wireline ground 20 to the tool ground 166. The hot path 50 through the device 14 is open because the prong 64 is spaced from the receptacle 104. In addition, a short circuit 163 exists between the tool hot and ground connections 162, 166 because the contact 122 is in electrical communication between the metal rod 110 and the housing body 126. It will be evident that the explosive charge 164 cannot be detonated in the configuration of FIG. 3 for several reasons. First, the hot wire 18 is not connected to the detonating charge 164. Second, any current that is induced in either of the leads 162, 166 applies an equal voltage across the explosive device 164. Consequently, the explosive device 164 cannot be detonated and such current is leaked off through the ground connection 20 of the wireline 12.

Figure 4:
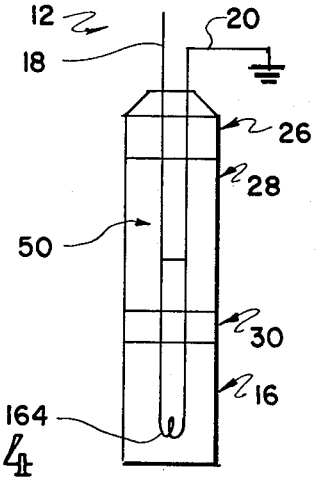

In operation, the assembly 10 is lowered into a liquid filled borehole. As the device 14 is lowered, the hydrostatic pressure in the passages 74 increases with depth. At any selected predetermined value, for example 125 psig, the pressure acting on the operative piston face 82 overcomes the force of the spring 98 to raise the piston 78. Initial movement of the piston 78 causes the prong 64 to enter the blind passage 106 thereby completing the electrical path 50 through the device 14 as shown in FIG. 4. It will be noted, however, that the contact 122 does not raise off or out of contact with the housing body 126 during initial movement of the piston 78. Accordingly, the short circuit 163 between the path 50 and the housing body 126 still exists. Accordingly, any stray currents in the hot wire 18 leak off through the ground connection 20.

Figure 5:
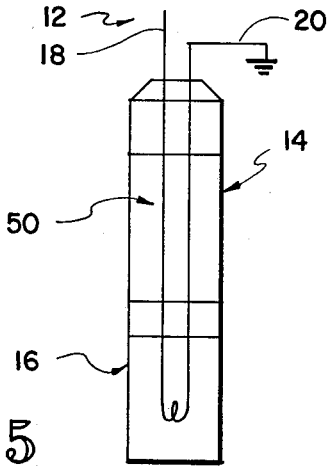

Continued upward movement of the piston 78 occurs because of the lapse of time or due to increased pressure in the passages 74 caused by continued lowering of the well assembly in the well bore. As the piston 78 continues its upward movement, the enlarged shoulder 120 on the bottom of the metal rod 110 ultimately engages the contact 122 and raises the contact 122 out of engagement with the beveled edge 140 of the housing body 126. At this time, the short circuit 163 between the hot path 50 and the ground path through the device 14 is broken leaving the well assembly configuration as shown in FIG. 5. Accordingly, the well assembly 10 is armed and can be fired merely by the application of suitable voltage and current through the hot wire 18.

It will be evident that withdrawal of the wall assembly 10 from the well bore causes the arming and disarming device 14 to operate in a reverse fashion. As the device 14 rises in the borehole, pressure in the passages 74 ultimately declines to a value which allows the spring 98 to force the piston 78 downwardly [or to the right in FIG. 1]. The shoulder 120 will pass sufficiently into the insulating sleeve 138 to allow the contact 122 to engage the beveled edge 140 thereby creating the short circuit between the hot path 50 and the ground path provided by the housing 24. Further withdrawal of the well assembly 10 reduces pressure in the passages 74 to allow the spring 98 to move the piston 78 to its downmost position illustrated in FIG. 1 to disengage the prong 64 from the receptacle 108 thereby breaking the electrical path 50 and creating the configuration shown in FIG. 3. This is of substantial importance at any time there is an unfired explosive device being removed from the well, as may be caused by a misfire or the like. It will be seen that the explosive tool 16 is safe as it is removed from the well bore.

Figure 6:
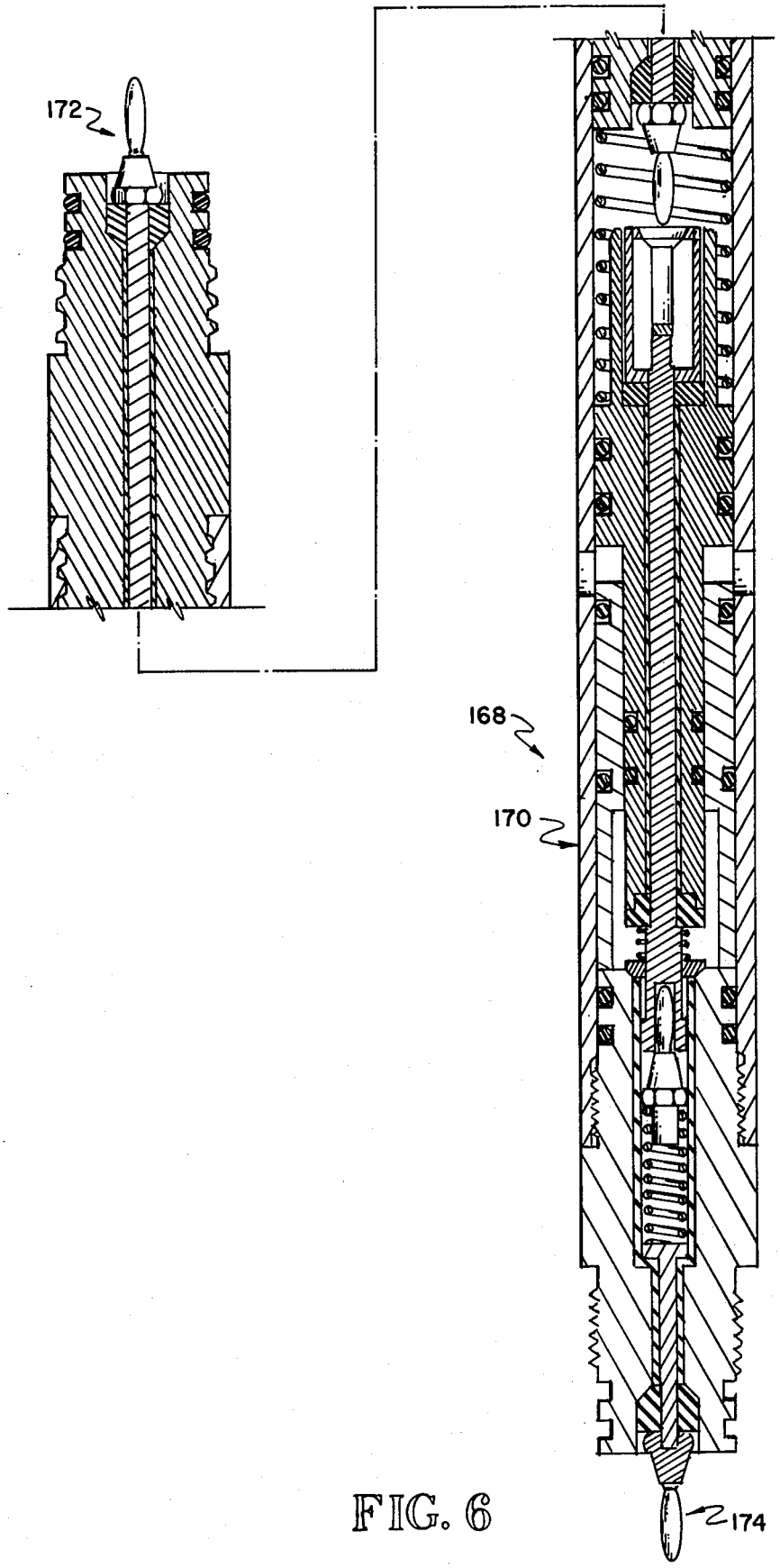
FIG. 6 is a longitudinal cross-sectional view of another embodiment of this invention.

Referring to FIG. 6, there is illustrated another embodiment 168 of the arming and disarming device of this invention. The device 168 differs only slightly from the device 14. First, the device 168 comprises a housing 170 which is of considerably smaller external diameter so that it may be run inside tubing with, for example, a through tubing perforating gun. Second, the upper electrical connection 172 is somewhat different configuration in order to be compatible with the electrical connections of tubing wireline bushings. Third, the lower electrical connection 174 is of somewhat different configuration in order to be compatible with the electrical connections of through tubing guns.

Figure 7:
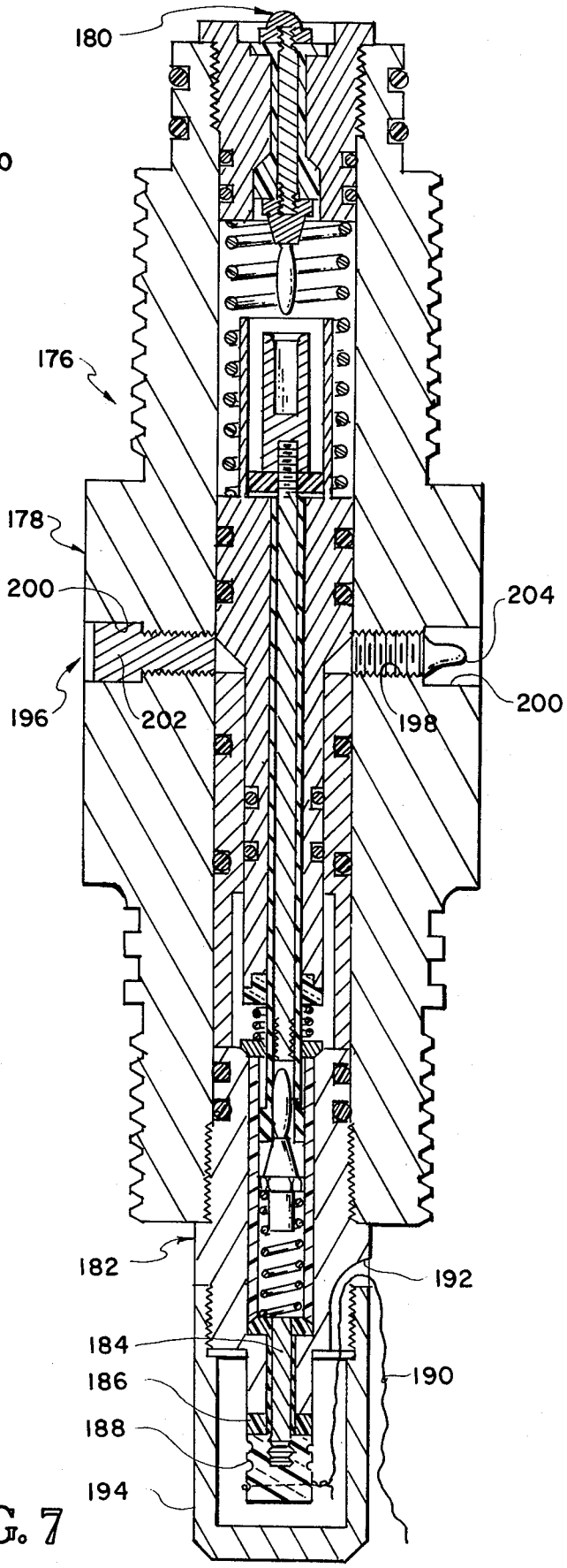
FIG. 7 is a longitudinal cross-sectional view of a third embodiment of the invention.

Referring to FIG. 7, there is illustrated another embodiment 176 of this invention. The embodiment 176 differs only slightly from the arming device 14. Basically, the device 176 is incorporated in a housing 178 which is of the same dimension as a single sub of a casing perforating gun. Consequently, the upper electrical connection 180 is of somewhat different design to be compatible with casing gun connections. In addition, the lower end of the device 176 has been modified slightly.

In this regard, the housing 178 comprises a threaded bushing 182 through which an exteriorly insulated metal rod 184 extends. An insulating washer 186 separates the bushing 182 from an externally grooved metallic nut 188 threaded onto the end of the metal rod 184. An externally insulated electrical wire 190 may be looped in one of the grooves of the nut 188 and passed through a notch or groove 192 in the bushing 182. An end cap or bull plug 194 is threaded onto the bushing 182. The device of FIG. 7 is of particular advantage when used in a casing perforating gun since it is extremely short. In addition, the bull plug 194 protects the bottom of the device 176 from blast caused by a subjacent shaped charge.

It will be evident that the device 14 may be used to arm and disarm a wide variety of explosively operated well tools. It will particularly be seen that the arming device 14 may be used to disarm a long string of explosive devices, such as is typical of perforating guns, core barrels and the like. It will also be noted that the arming device 14 does not interfere in any fashion with detonation of the charges in the well tool 16 so that well tool 16 may comprise a plurality of explosive charges which are shot simultaneously or which are shot sequentially. It will also be seen that the device 14 is usable with basically single shot explosive devices such as casing cutters, string shots and the like.

The mode of operation previously described is typical of use of the device 14 in a well bore filled with a liquid drilling or completion fluid. In the event the well bore is filled with air or other gas, there may be insufficient hydrostatic head to move the piston 78 assuming a reasonably strong spring 98. Althrough the spring 98 may be designed to be sufficiently weak to allow upward movement of the piston 78 at very low pressures inside the passage 74, it may be preferred to configure the device as shown in FIG. 7 wherein the comparable passages 196 comprise an inner threaded section 198 and an enlarged outer section 200. A bull plug 202 is positioned in all but one of the passages 196 with a grease zerk 204 threaded into the other passage. The grease zerk 204 is configured to receive a grease gun so that the piston 206 may be pumped up into the armed configuration. The grease zerk 204, of course, includes a suitable mechanism (not shown) to prevent backward flow of grease caused by the spring 208 acting on the piston 206. With this configuration, the arming device 176 and its associated explosive well tool may be run through the rotary of a rig so that the passages 196 are exposed above the rotary and the explosive well tool is in the top of the well bore. A grease gun (not shown) may then be operatively connected to the grease zerk 204 and grease injected into the device 176 to move the piston 206 upwardly to arm the associated well tool. In this fashion, the well tool will be armed only after it is in the bore hole. When coming out of the hole with the device 176, when the passages 196 clear the rotary, a suitable grease fitting (not shown) may be pressed onto the open end of the grease zerk 204 to allow the grease inside the device 176 to flow outwardly under the impetus provided by the spring 208.

Although the invention has been described in its preferred forms with a certain degree of particularity, it is understood that the present disclosure of the preferred embodiment is by way of example only and the numerous changes in the details of construction and combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

I claim:

1. A device, runnable into a well bore on a two path wireline providing a hot path and a ground path, for arming and disarming an explosive well tool having a hot lead and a ground, comprising a housing having a passage opening through a side thereof;

first and second means on the housing for electrical connection respectively to the tool ground and the tool hot lead upon assembly of the tool to the device;

third and fourth means on the housing for electrical connection respectively to the wireline ground path and the wireline hot path upon assembly of the device to the wire line;

means providing a first electrical path through the housing between the first and third means; and means for arming and disarming the tool including means providing a normally open second electrical path, separate from the first path, between the second and fourth means including means responsive to a first predetermined pressure in the passage for completing the second electrical path; and means short circuiting the first and second means in the open configuration of the second electrical path including means responsive to a second predetermined pressure in the passage for breaking the short circuit.

2. The device of claim 1 wherein the first predetermined pressure is different than the second predetermined pressure.

3. The device of claim 2 wherein the first predetermined pressure is less than the second predetermined pressure.

4. The device of claim 1 wherein the housing is metallic and comprises the means providing the first electrical path.

5. The device of claim 4 wherein the first electrical path is uninterruptible in the assembled condition of the device.

6. The device of claim 1 wherein the housing comprises a side wall closed about a longitudinal axis, the passage opening through the side wall.

7. The device of claim 1 further comprising a grease fitting in the passage enabling the injection of a fluid into the passage.

8. The device of claim 7 wherein the piston is electrically conductive and the second switch contact is insulated from the piston.

9. The device of claim 7 wherein the short circuiting means comprises a third switch contact carried by the piston;

a fourth switch contact carried by the housing in electrical communication with the first electrical path;

a fifth switch contact carried by the housing in electrical communication with the second means; and the third switch contact engaging the fourth and fifth switch contacts in the disarmed position of the piston.

10. The device of claim 1 wherein the means providing the normally open second electrical path comprises a first switch contact in the housing and electrically connected to the fourth means;

a piston having an operative face exposed to the passage for movement in a first direction in response to pressure therein and carrying a second switch contact facing and normally spaced from the first switch contact; and means biasing the piston in a second direction opposite from the first direction toward a disarmed position.

11. A device, runnable into a well bore on a two path wireline providing a hot path and a ground path, for arming and disarming an explosive well tool having a hot lead and a ground, comprising an electrically conductive housing having a longitudinal axis and a sidewall closed thereabout providing a fluid passage transverse to the axis;

the housing being configured to electrically connect to the wireline ground path and the tool ground path upon assembly of the device to the wireline and the tool providing a first uninterruptible electrical path through the device;

first and second means on the housing for electrical connection respectively to the wireline hot path and the tool hot lead upon assembly of the device to the wireline and tool;

means in the housing providing a normally open second electrical path, separate from the first path, between the first and second means, including a piston having an operative face exposed to the passage and movable from a normal disarmed position to an armed position in response to fluid pressure in the passage;

an electrically conductive member, carried by the piston, extending longitudinally thereof and insulated from the housing;

a first group of normally open switch contacts adjacent one end of the piston including a first switch contact carried by the housing and electrically connected to the wireline hot path and a second switch contact carried by the piston and electrically connected to the conductive member;

a second group of normally closed switch contacts adjacent the other end of the piston including a third switch contact carried by the piston, a fourth switch contact electrically connected to the housing and a fifth switch contact electrically connected to the second means, the third switch contact being normally in engagement with the fourth and fifth switch contacts; and means normally biasing the piston to the disarmed position wherein the first group of switch contacts are open and the second group of switch contacts are closed.

12. A method of handling an explosive well tool of the type having a hot lead and a ground with a wireline having a ground path and a hot path with an arming sub having a conductive hot connection and a conductive ground connection, comprising disarming the well tool including connecting the arming sub ground connection between the tool ground and the wireline ground path, connecting the tool hot lead to the arming sub hot connection, connecting the arming sub hot connection to the wireline ground path and electrically isolating the wireline hot path;

running the tool into a well bore; and then arming the tool including connecting the wireline hot path to the arming sub hot connection and disconnecting the arming sub hot connection from the wireline ground path.

13. The method of claim 12 wherein the arming step comprises disconnecting the arming sub hot connection from the wireline ground path after connecting the wireline hot path to the arming sub hot connection.

14. The method of claim 12 wherein the tool provides a plurality of explosive devices and the arming step is followed by detonating a first of the explosive devices.

15. The method of claim 12 wherein the tool provides a single explosive device and the arming step is followed by detonating the explosive device.

16. The method of claim 12 wherein the tool is run into a liquid filled bore hole and the arming step comprises connecting the wireline hot path to the arming sub hot connection in response to hydrostatic pressure in the bore hole.

17. The method of claim 16 wherein the arming step comprises disconnecting the arming sub hot connection from the wireline ground path in response to hydrostatic pressure in the bore hole.

* * * * *